US005370420A

United States Patent [19]

Khatib et al.

[11] Patent Number: 5,370,420

[45] Date of Patent: Dec. 6, 1994

[54] PRESSURE SENSITIVE LABEL FOR HIGH SPEED LASER PRINTERS

[75] Inventors: Khaled M. Khatib, Youngstown; Joseph W. Langan, Cheektowaga, both of N.Y.

[73] Assignee: Moore Business Forms, Inc., Grand Island, N.Y.

[21] Appl. No.: 8,795

[22] Filed: Jan. 25, 1993

[51] Int. Cl.[5] ..... B42D 15/00

[52] U.S. Cl. ..... 283/81; 283/101; 462/2

[58] Field of Search ..... 283/81, 101, 105, 110, 283/111; 425/40–43; 462/2, 26

[56] References Cited

U.S. PATENT DOCUMENTS

| | | | |
|---|---|---|---|
| 3,993,814 | 11/1976 | Cavender | 428/40 |
| 4,462,039 | 7/1984 | Small et al. | 281/110 |
| 4,637,635 | 1/1987 | Levine | 283/101 |
| 4,876,131 | 10/1989 | Ashby et al. | 428/42 |
| 5,028,040 | 7/1991 | Kalisiak | 270/52 |
| 5,090,942 | 2/1992 | Traise | 462/66 |
| 5,139,836 | 8/1992 | Burke . | |
| 5,147,699 | 9/1992 | Browning et al. . | |

FOREIGN PATENT DOCUMENTS

| | | |
|---|---|---|
| 0488813A2 | 6/1992 | European Pat. Off. . |
| 2242920 | 3/1975 | France . |
| 2225766A | 12/1988 | United Kingdom . |

*Primary Examiner*—Willmon Fridie
*Attorney, Agent, or Firm*—Nixon & Vanderhye

[57] ABSTRACT

A pressure sensitive label form construction suitable for processing through a laser printer includes a base sheet having length and width dimensions and an upper surface coated with a release composition; and a label face sheet removably adhesively secured to the upper surface of the base sheet. The label face sheet is die cut into a plurality of individual labels and has an adhesive applied to a lower surface thereof, and a toner-receptive coating applied to an upper surface thereof. The label sheet has a width dimension less than the width dimension of the base sheet so as to avoid adhesive contamination of the printer.

11 Claims, 1 Drawing Sheet

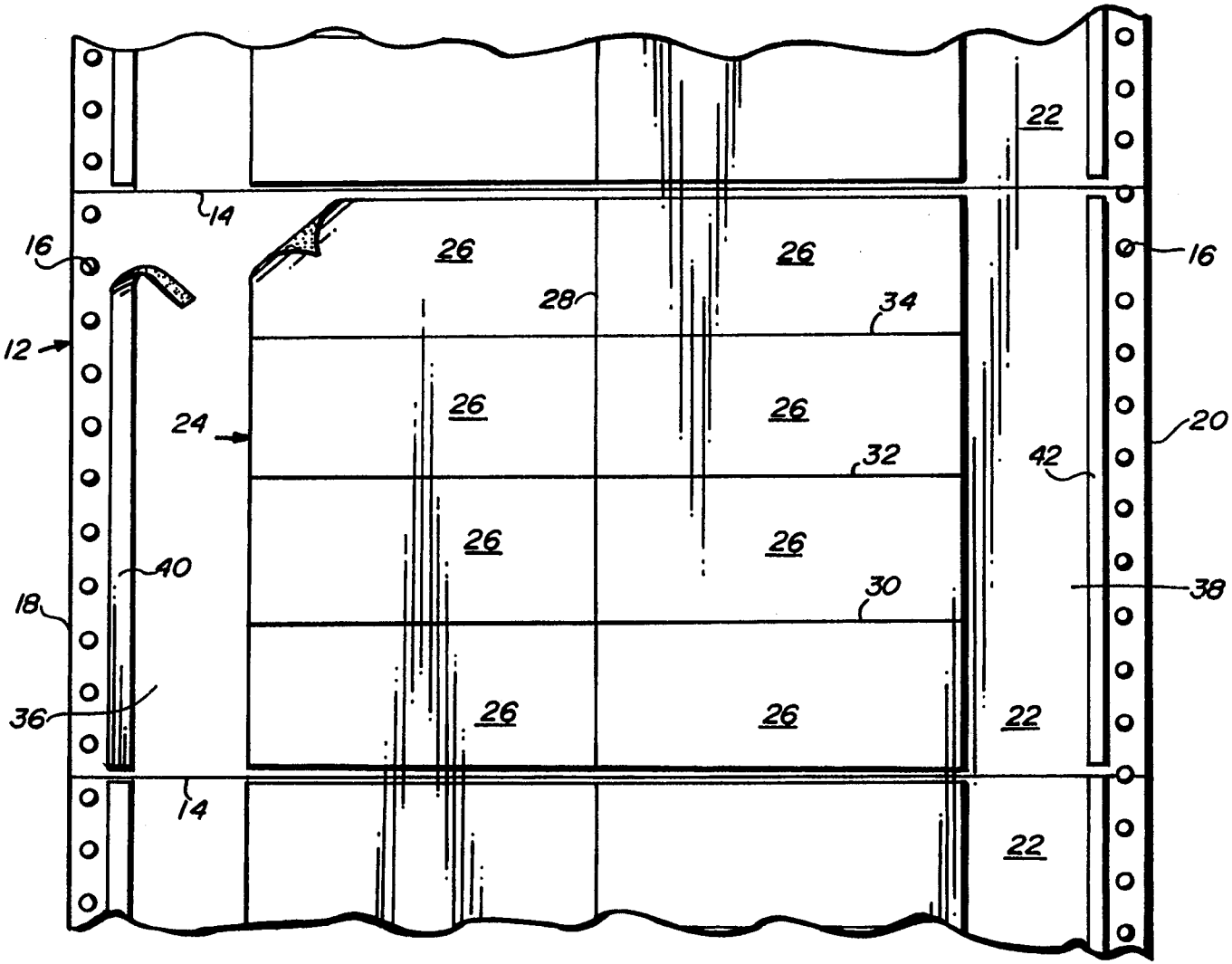
16
20
38
22
42
22
22
34
32
30
26
26
26
26
28
26
26
26
26
14
24
40
14
16
12
18
36

PRESSURE SENSITIVE LABEL FOR HIGH SPEED LASER PRINTERS

This invention relates to a unique label construction which can be processed through high speed continuous laser printers.

BACKGROUND AND SUMMARY OF THE INVENTION

Currently, there are few products which will process through high speed continuous laser printers, such as the IBM 3800. Of the companies addressing this market segment currently known to applicant, none have a label construction which will process through a high speed laser printer in long, continuous runs. In the case of the IBM 3800 printer, the manufacturer specifies the caliper products to be in the 0.0022 inch to 0.003 inch range. Most acceptable label product constructions exceed this specification, however, and when fed through the printer, absorb a significant amount of heat from the toner fusing station, causing the printer to shut down. In addition, the printer manufacturer does not recommend processing pressure sensitive labels through the above noted printer, not only due to the thickness of the two-ply construction, but also because of possible adhesive contamination of the printer.

It is a principal object of this invention to provide a pressure sensitive label construction which can be processed through a high speed laser printer without absorbing excessive heat from the unit's toner fusing system, and without adhesive contamination of the printer.

In accordance with an exemplary embodiment of the invention, a pressure sensitive label form is provided which includes a release coated liner supporting a face sheet having a adhesive layer on its lower surface and a toner receptive coating on its upper surface. The face sheet, which is adhesively attached to the release coated liner, is die cut into individual labels.

The release coated liner is larger in the width dimension than the face sheet, extending outwardly away from either side of the face sheet. Since the adhesive on the face sheet is located away from the edges of the liner, adhesive contamination of the printer by the form product is not likely. It is a further optional feature of the invention to include a label strip along one or both of the marginal edges of the liner (but inside the tractor feed holes) to allow a sense mark to be placed in the margin for registration control.

Thus, in accordance with an exemplary embodiment of the invention, there is provided a pressure sensitive label form construction comprising a base sheet having length and width dimensions and an upper surface coated with a release composition; and a label face sheet removably adhesively secured to the upper surface of the base sheet; wherein the label sheet has a width dimension less than the width dimension of the base sheet.

In another aspect, the invention relates to a pressure sensitive label form construction suitable for processing through a laser printer comprising a base sheet having length and width dimensions and an upper surface coated with a release composition; and a label face sheet removably adhesively secured to the upper surface of the base sheet, the label face sheet having an adhesive applied to a lower surface thereof, and a toner-receptive coating applied to an upper surface thereof, and the label face sheet being die cut into a plurality of side-by-side labels; wherein the label face sheet has a width dimension less than the width dimension of the base sheet, such that adhesive contamination of the printer is avoided.

Additional objects and advantages of the invention will become apparent from the detailed description which follows.

BRIEF DESCRIPTION OF THE DRAWING

The single Figure illustrates a plan view of a pressure sensitive label construction in accordance with an exemplary embodiment of the invention.

DETAILED DESCRIPTION OF THE DRAWINGS

With reference to the Figure, a continuous forms assembly 10 includes a continuous base web 12 which is divided into individual forms by transverse lines of perforation 14. The web 12 is also provided with tractor feed holes 16 on either side of the web, adjacent marginal edges 18 and 20. The tractor feed holes may be within removable marginal strips if desired (as defined by additional longitudinal lines of perforation located inside the tractor feed holes, not shown).

The web 12 comprises a release coated liner in that the upper surface of the web or base sheet is coated with a conventional release coating composition for a purpose described below.

Each web or base sheet 22, as defined by a pair of transverse lines of perforations 14, has a face sheet 24 positioned thereon. The face sheet 24 is coated on its underside with an adhesive layer by which the face sheet is held to the web sheet or liner 24. The release coating on the sheet 22 permits the face sheet to be removed therefrom without damaging the liner and without destroying the effectiveness of the adhesive on the face sheet.

The face sheet 24 is die cut into individual adhesive labels 26, as indicated by longitudinal cut line 28 transverse cut lines 30, 32 and 34. The face sheet 24 not as wide as the web sheet or liner 22, such that significant marginal areas 36, 38 of web sheet or liner 22 lie on either side of the face sheet 24. In the longitudinal direction, the face sheets 24 terminate substantially at or adjacent the transverse lines of perforations 14.

The upper surface of face sheet 24 is coated with a toner-receptive coating to permit printing on the labels as the form passes through the laser printer.

As a result of the arrangement of face sheet 24 on web or liner sheet 22, it will be appreciated that the adhesive on the back of the face sheet 24 (i.e. labels 26) is located away from the marginal edges 18 and 20 as well as tractor feed holes 16 and thus, potential contamination of the printer is minimized if not eliminated.

Label strips 40, 42 (having a width of, for example, $\frac{1}{4}$") may be placed along the edges of the form construction, inside the tractor feed holes 16, to allow sensing mark (bar code or other suitable mark) to be placed in the margin for registration control. These strips are preferably of the same composition as the face sheets 24. By locating the strips 40, 42 inside the tractor feed holes 16, potential adhesive contamination of the printer is minimized.

It has been found that the above described form construction may be processed through high speed laser printers without absorbing too much heat from the unit's toner fusing system and without adhesive contamination which might otherwise cause printer shutdown.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A pressure sensitive label form construction comprising:

a base sheet having length and width dimensions and an upper surface coated with a release composition; and a label face sheet removably adhesively secured to said upper surface of said base sheet, said label face sheet having an upper surface having a toner-receptive coating applied thereto, and a lower surface having an adhesive layer applied thereto;

wherein said label sheet has a width dimension at least two inches less than the width dimension of the base sheet.

2. The pressure sensitive label form of claim 1 wherein said label sheet is die cut into a plurality of individual labels.

3. The pressure sensitive label form of claim 1 wherein said label sheet is die cut into a plurality of individual labels.

4. A pressure sensitive label form construction comprising:

a base sheet having length and width dimensions and an upper surface coated with a release composition; and a label face sheet removably adhesively secured to said upper surface of said base sheet;

wherein said label sheet has a width dimension less than the width dimension of the base sheet and including a sensing strip adhesively secured in at least one marginal area of said base sheet.

5. A pressure sensitive label form construction comprising:

a base sheet having length and width dimensions and an upper surface coated with a release composition: and a label face sheet removably adhesively secured to said upper surface of said base sheet;

wherein said label sheet has a width dimension less than the width dimension of the base sheet and including a pair of sensing strips, one in each of two marginal areas of said base sheet.

6. The pressure sensitive label form of claim 5 wherein each sensing strip has a longitudinal dimension substantially equal to the longitudinal dimension of the base sheet.

7. The pressure sensitive label form of claim 6 wherein each sensing strip has a width dimension of about ¼ inch.

8. A pressure sensitive label form construction suitable for processing through a laser printer comprising:

a base sheet having length and width dimensions and an upper surface coated with a release composition; and a label face sheet removably adhesively secured to said upper surface of said base sheet, said label face sheet having an adhesive applied to a lower surface thereof, and a toner-receptive coating applied to an upper surface thereof, and said label face sheet being die cut into a plurality of side-by-side labels;

wherein said label sheet has a width dimension sufficiently less than the width dimension of the base sheet so that adhesive contamination of the printer is avoided.

9. The pressure sensitive label form of claim 8 wherein the base sheet is in continuous web form and wherein individual base sheets are defined by longitudinally spaced, transverse lines of perforations.

10. A pressure sensitive label form construction suitable for processing through a laser printer comprising:

a base sheet having length and width dimensions and an upper surface coated with a release composition; and a label face sheet removably adhesively secured to said upper surface of said base sheet, said label face sheet having an adhesive applied to a lower surface thereof, and a toner-receptive coating applied thereto, and said label face sheet being die cut into a plurality of side-by-side labels;

wherein said label sheet has a width dimension less than the width dimension of the base sheet, such that adhesive contamination of the printer is avoided and including a sensing strip adhesively secured in at least one marginal area of said base sheet.

11. A pressure sensitive label form construction suitable for processing through a laser printer comprising:

a base sheet having length and width dimensions and an upper surface coated with a release composition; and a label face sheet removably adhesively secured to said upper surface of said base sheet, said label face sheet having an adhesive applied to a lower surface thereof, and a toner-receptive coating applied to an upper surface thereof, and said label face sheet being die cut into a plurality of side-by-side labels;

wherein said label sheet has a width dimension less than the width dimension of the base sheet, such that adhesive contamination of the printer is avoided and including a pair of sensing strips, one in each of two marginal areas of said base sheet.

* * * * *